United States Patent [19]

Duley

[11] Patent Number: 4,862,162

[45] Date of Patent: Aug. 29, 1989

[54] ENVIRONMENTAL TRACKING IN INDUCTANCE LOOP VEHICLE DETECTION SYSTEMS

[75] Inventor: Richard K. Duley, Hampshire, England

[73] Assignee: Sarasota Automation Limited, Hampshire, England

[21] Appl. No.: 80,148

[22] Filed: Jul. 30, 1987

Related U.S. Application Data

[63] Continuation of Ser. No. 557,302, Dec. 2, 1983, abandoned.

[30] Foreign Application Priority Data

Dec. 2, 1982 [GB] United Kingdom ..... 8234408

[51] Int. Cl.[4] ..... G08G 1/01

[52] U.S. Cl. ..... 340/938; 340/939; 340/941; 364/178; 324/236

[58] Field of Search ..... 340/938, 939, 941; 324/225, 236; 364/178, 179

[56] References Cited

U.S. PATENT DOCUMENTS

| | | | |
|---|---|---|---|
| 3,820,100 | 6/1974 | Ballinger et al. | 340/939 |
| 3,943,339 | 3/1976 | Koerner et al. | 340/939 |
| 3,989,932 | 11/1976 | Koerner | 340/939 |
| 4,296,401 | 10/1981 | Duley | 340/938 |
| 4,388,611 | 6/1983 | Haferd | 364/178 |
| 4,430,636 | 2/1984 | Bruce | 340/941 |
| 4,491,841 | 1/1985 | Clark | 340/939 |

*Primary Examiner*—John W. Caldwell, Sr.
*Assistant Examiner*—Tyrone Queen

[57] ABSTRACT

In a vehicle presence detection system in which an inductive sensor loop is the frequency-determining element of the tuned circuit of a loop oscillator, discrimination against variations in inductance due to environmental changes is achieved by comparing detect and tracking reference numbers with a sample number that is a function of the oscillator frequency and updating each reference number repeatedly at real time intervals independent of loop oscillator frequency. The current sample number is compared with either the tracking reference or the detect reference according to whether or not the system is indicating the presence of a vehicle. In the case of the tracking reference, if the difference between it and the sample is no greater than a threshold value, each reference is updated by repeatedly incrementing or decrementing it by a predetermined amount for a number of times determined by the time that has elapsed since the last comparison cycle, but if the difference is greater than the threshold, indicating a vehicle movement, the tracking reference is immediately made substantially equal to the sample in one step. Both the threshold values and the predetermined amounts of increment or decrement may be different for different directions of change. In a permanent vehicle presence detecting system, the detect reference is updated in a similar manner except that there is no change of the detect reference if the difference threshold is exceeded. In a system that only detects a continuously present vehicle for a finite presence time and then 'forgets' it, the detect reference is only incremented stepwise for change in one direction, changes in the opposite direction being accomplished by making the detect reference equal to the sample in one step.

11 Claims, 4 Drawing Sheets

-38-

-38-

ENVIRONMENTAL TRACKING IN INDUCTANCE LOOP VEHICLE DETECTION SYSTEMS

This is a continuation of application Ser. No. 557,302 filed Dec. 2, 1983 now abandoned.

This invention relates to inductive loop vehicle detectors, such as are employed in automatic vehicle-responsive road traffic light signal installations.

It is common practice in vehicle detection to use an inductive sensor loop as the frequency-determining element of a tuned circuit in a Colpitts oscillator. An inductance change in the loop due to the arrival of a vehicle can be sensed by making periodic measurements of the oscillator frequency. However, in addition to mere detection of the presence of a vehicle, it is necessary to discriminate against variations in stray capacitance that are due to environmental changes, and also to cope with the problem of a vehicle remaining stationary for a long period in the vicinity of the inductive loop.

It is therefore usual to compare a sample number that is a function of the oscillator frequency with a reference number that is updated in accordance with environmental changes. Since the updating of the reference has hitherto been performed at intervals that are a function of a particular number of loop cycles, the update characteristic is dependent on loop frequency, and this has disadvantages. A particular disadvantage is that such a system cannot be relied upon to react safely in the case of an abnormally large change in loop inductance, for example in the case of a damaged loop.

According to the present invention, there is provided a method of discriminating against parameter variations due to environmental changes, comprising the steps of repeatedly comparing a variable sample number that is a function of the oscillator inductance with a reference number, and repeatedly updating the reference number in accordance with detected environmental changes at predetermined real time intervals independent of the system operational frequency. The system is accordingly not prone to behave unpredictably in the event of a massive change in loop inductance such as might be occasioned by the loop becoming damaged.

Figure 1A:
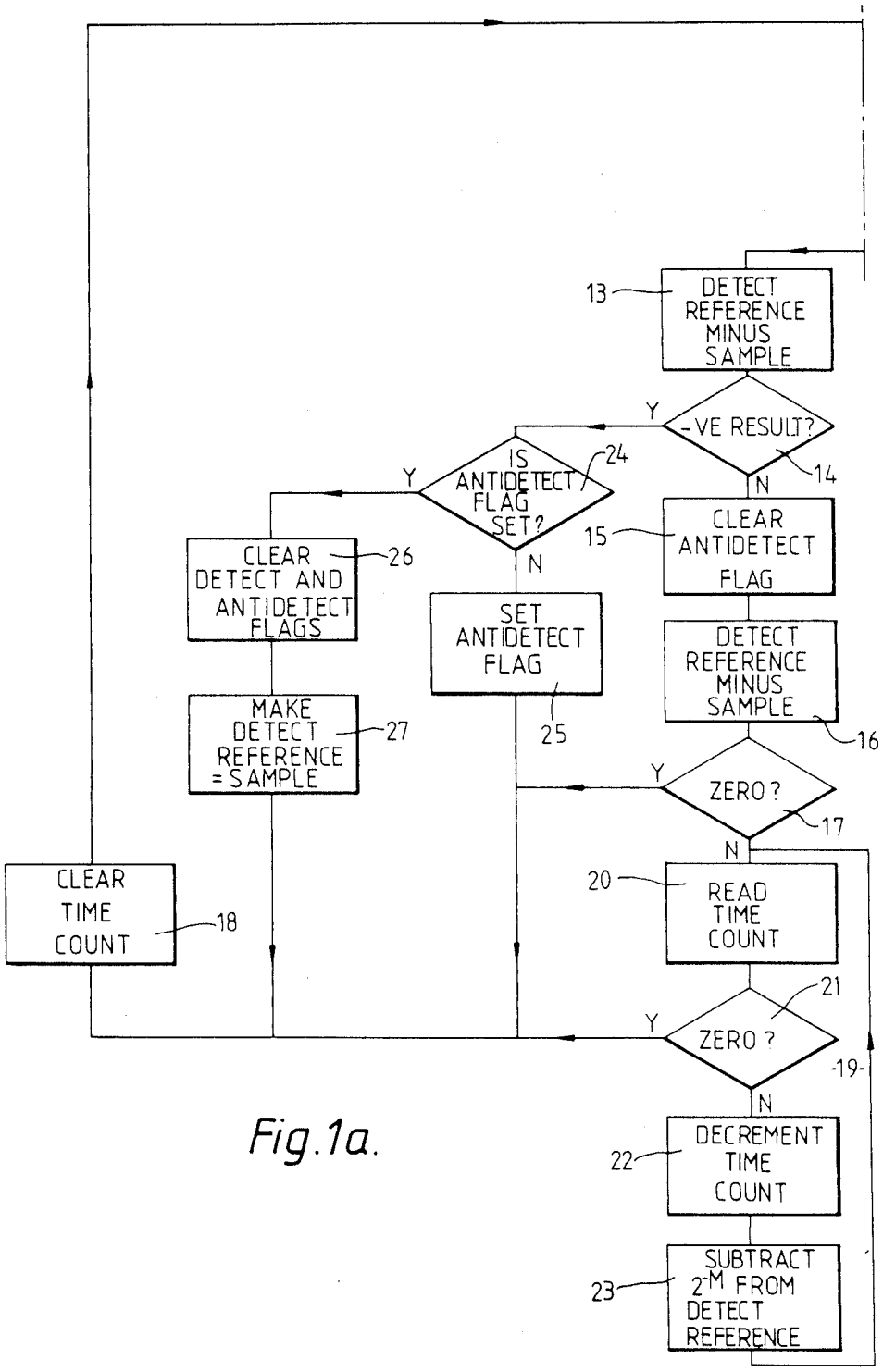
Figure 1B:
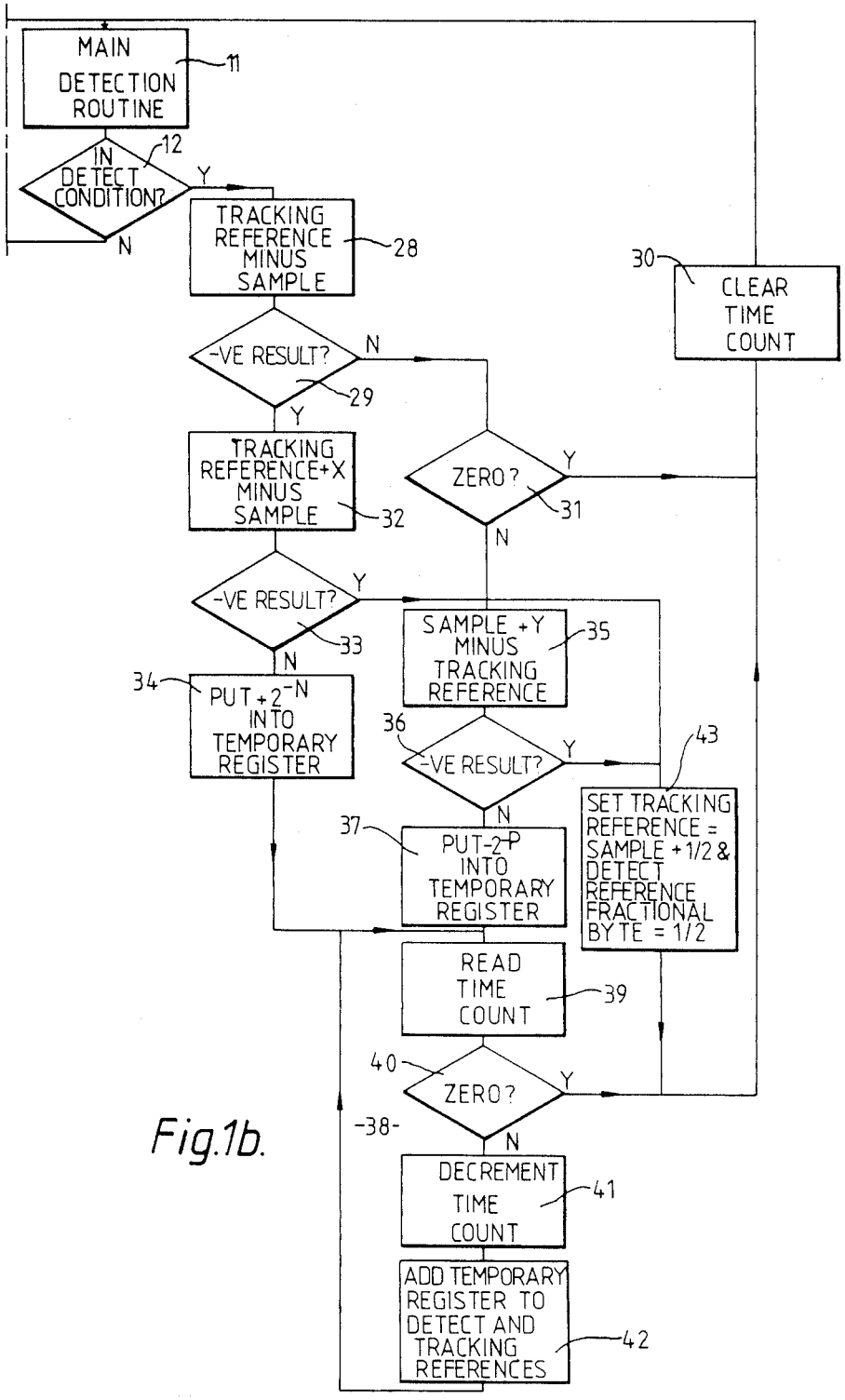
Figure 2A:
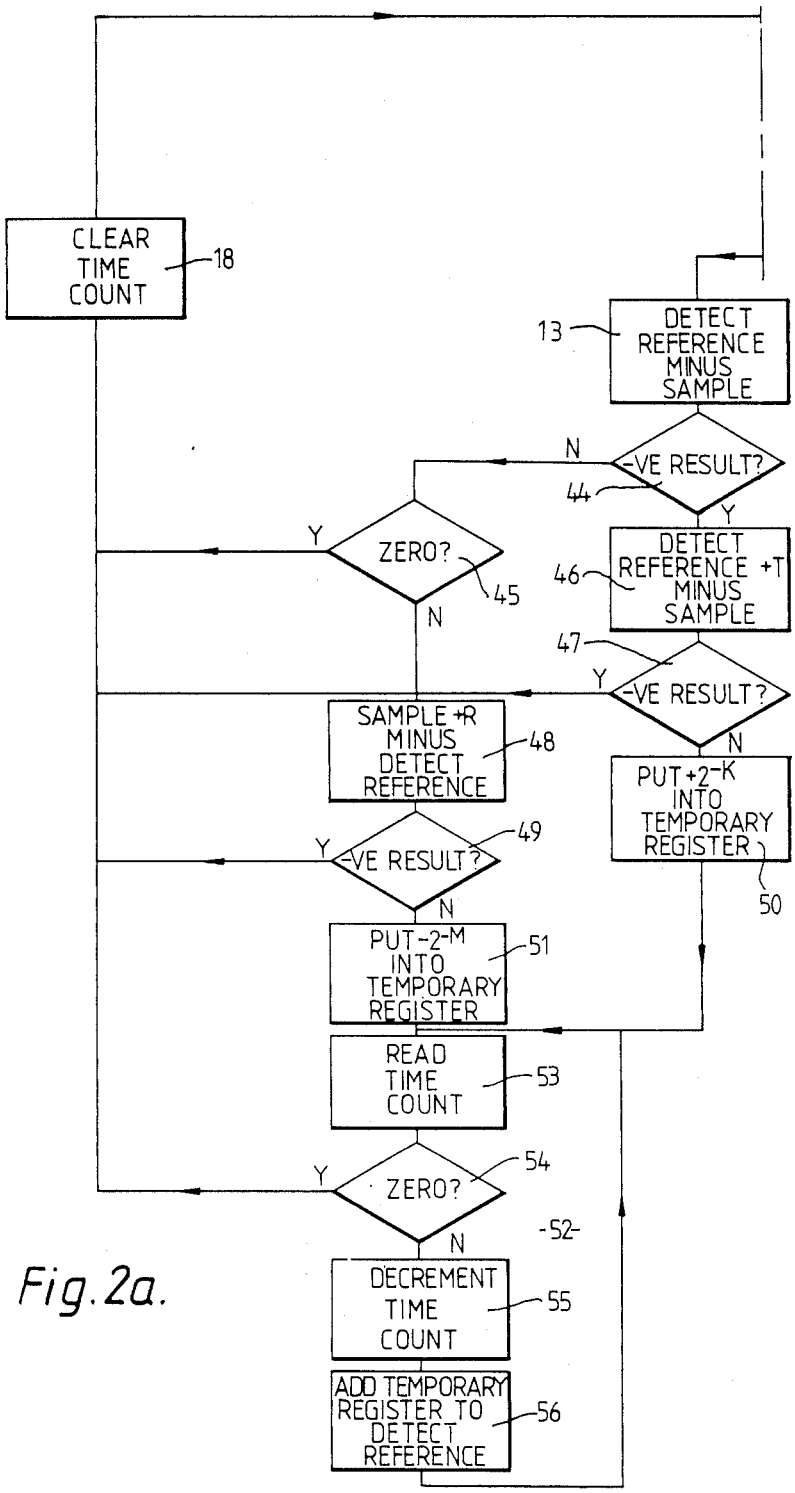
Figure 2B:
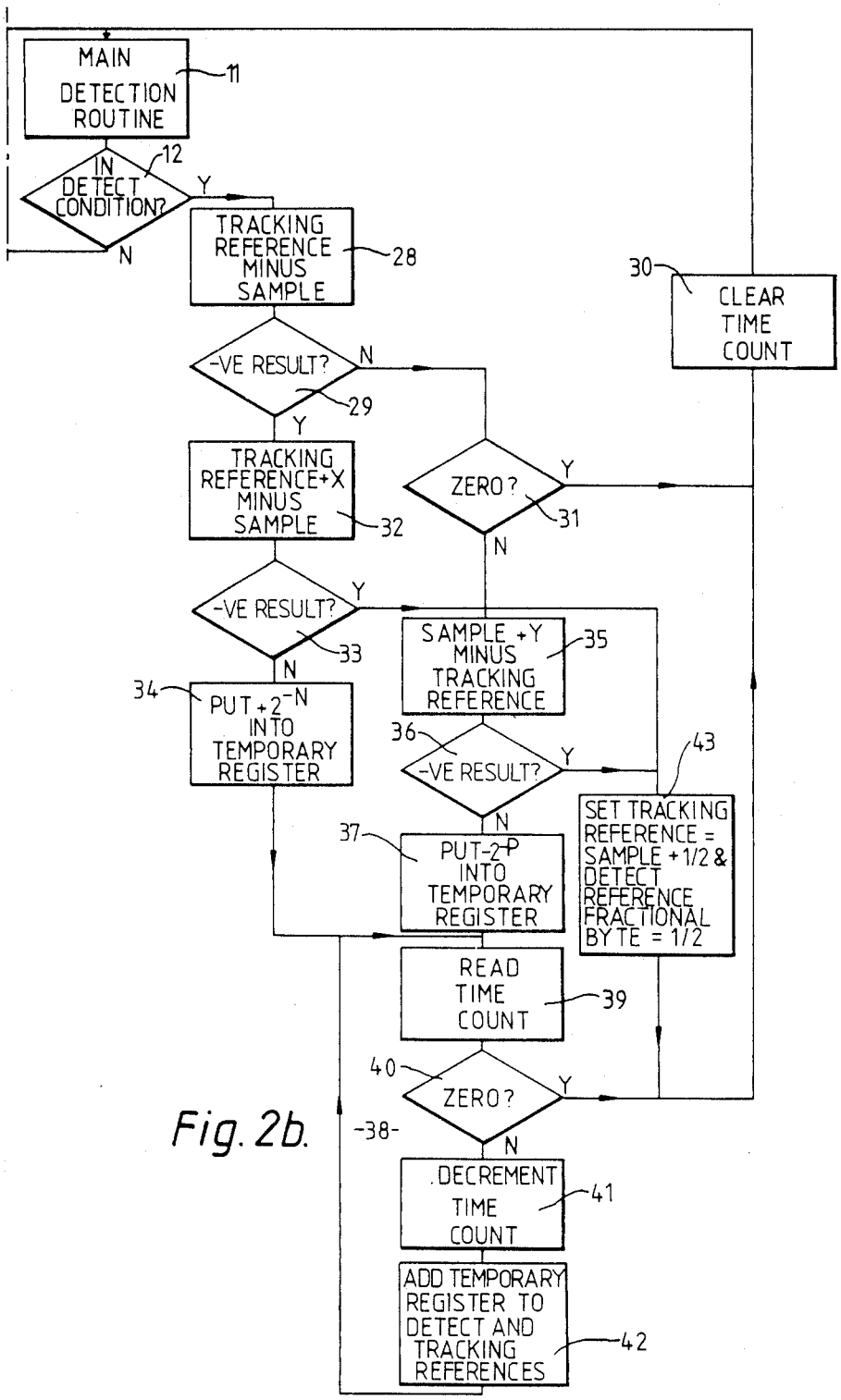

Ways of carrying the invention into practice will not be described by way of example with reference to the accompanying drawings, in which:

FIGS. 1*a* and 1*b* are flow charts illustrating environmental updating based on finite presence detection, and FIGS. 2*a* and 2*b* are flow charts illustrating environmental updating based on permanent presence detection.

Considering the case of a vehicle, e.g. an illegally parked vehicle, that remains stationary for a long period in the vicinity of a loop, there are two ways of dealing with this. One way is to arrange that the system "forgets" that a stationary vehicle is present a certain pre-set time interval after the presence of the vehicle is initially detected. This is known as "finite presence" detection; and the effect is that after the pre-set time has elasped, the system treats the presence of the vehicle as part of the general environment without any longer responding to it specifically as a vehicle. The other way of dealing with the long-term stationary vehicle is for the system to "remember" the presence of the vehicle independently and respond to it always as a detected vehicle. This is known as "permanent presence" detection.

Referring now to the flow chart of FIGS. 1*a* and 1*b* illustrating environmental updating based on "finite presence" detection, the system is implemented by a micro-computer with a crystal-controlled real time clock, arranged to handle multi-channelled, and typically 4-channelled inputs, by time division multiplexing. The main detection routine 11 is in accordance with our U.S. patent application Ser. No. 521,814 filed Aug. 10, 1983 now U.S. Pat. No. 4,668,951 and will therefore not be further described here.

Firstly, a decision is made, at 12, as to whether the system is in the detect condition. If the naswer is 'No', i.e. the system is not indicating the presence of a vehicle, the operation branches to the left in the chart and a number representing the sample value derived from the current scan (the sample) is subtracted, at 13, from a stored number representing the environmental conditions (the detect reference). The detect reference number could include the effect of one or more long-stay stationary vehicles which the system has 'forgotten' because the pre-set finite presence time of that stationary vehicle, or each such vehicle, has expired. A decision is made, at 14, as to whether the result of the subtraction is negative indicating that the current sample is greater than the stored detect reference. Such result is needed because the routine is able to increase the detect reference number much more quickly than it can decrease it. This is because, if a 'forgotten' long-standing stationary vehicle leaves the vicinity of the loop, a large increase in the detect reference is needed almost instantaneously to take account of the consequential large and abrupt change in the environmental conditions. It will be understood that the change due to a 'forgotten' vehicle leaving is very much faster than any other kind of environmental change and it will be in the 'increase' direction.

If the answer to the question asked at 14 is 'No', the current sample is either equal to or smaller than the detect reference. Therefore, any change in environmental conditions has not been due to a stationary vehicle moving out and no large rapid change in the detect reference is required. The next step, at 15, is to clear an antidetect flag, the reason for which will be explained subsequently. Then the substraction previously performed at 13 is repeated, at 16, and the result tested, at 17, to see if it is zero. If the answer is 'Yes', there has been no change in the environment and the routine branches out, clears the time count, at 18, and returns to the main detection routine 11. If the answer is 'No', then a decrease in the detect reference is required. The routine then enters a loop 19 in which the loop sub-routine is repeated a number of times determined by the time that has elapsed since the last occasion that the system routine entered this part of the program.

In the loop 19 the time count is read, at 20, and the result is tested, at 21, to see if the count is zero—if the answer is 'No' the time count is decremented, as 22, and the detect reference has subtracted from it, at 23, a fractional amount $2^{-m}$, m being an integer chosen appropriately for the system. The time count is then reread and the loop sub-routine is repeated until the test of the time count, at 21 shows that the count has been decremented to zero. The sub-routine when branches out, clears the time count at 18 and returns to the main detection routine 11.

If the answer to the test at 14 shows that the subtraction at 13 has given a negative result, the current sample is larger than the detect reference, and the change may be due to departure of a forgotten longstanding vehicle, necessitating a large very rapid change in the detect reference. However, this will not occur unless the antidetect flag is set. The test for this is made at 24. If the result of the test at 14 has only just become negative, the previous result will have been positive or zero and will therefore have cleared the antidetect flag at 15. The test at 24 will, in that case, give a negative result, following which the antidetect flag will be set at 25 and the routine will branch out, clear the time count at 18 and return to the main detection routine 11. If the next update cycle again gives a negative result at 14, the antidetect flag having already been set the answer at test 24 will be 'Yes'. Therefore, after clearing of both detect and antidetect flags as 26, the detect reference is immediately made equal to the current sample at 27, which is the quickest way of achieving the required environmental update. The routine then clears the time count at 18 and returns to the main detection routine 11. The detect flag is in the main routine 11.

Returning to the initial test at 12, if the answer to whether the system is in the detect condition is 'Yes', the operation branches to the right in the chart and the number representing the sample value derived from the current scan in subtracted, at 28, from a stored number representing the previous sample value while the system is in the detect condition (the tracking reference). The result of this subtraction is tested at 29 to see if it is negative; if it is not, it is again tested at 31 to see if it is positive or zero. If it is zero, indicating that there has been no change in the sample value, the routine branches out, clears the time count at 30 and returns to the main detection routine 11. If the result of the subtraction at 28 is negative, the tracking reference is incremented by a threshold amount X and the subtraction performed again, at 32. The result of this further subtraction is tested, at 33, to see if it is negative. If it is, then the sample is greater than the tracking reference by more than the amount X by which the tracking reference was incremented at 32, which would indicate a vehicle movement. If, however, the result of the subtraction at 33 is not negative, then the sample is greater than the tracking reference by an amount not exceeding X, in which event the tracking reference needs to be increased by a small amount; in this case, a positive fractional quantity $+2^{-n}$ is stored in a temporary register, as at 34. As in the case of the power m, n is an integer having a value chosen appropriately for the system.

If the test at 31 shows that the result of the subtraction at 28 is not zero, the sample is incremented by a threshold amount Y and the tracking reference is substracted from it at 35. The result of this subtraction is tested, at 36, to see if it is negative. If it is, then the sample is less than the tracking reference by more than the amount Y by which the sample was incremented at 35, which would indicate a vehicle movement. If, however, the result of the subtraction at 35 is not negative, then the sample is less than the tracking reference by an amount not exceeding Y, in which event the tracking reference needs to be decreased by a small amount; in this case, a negative fractional quantity $-2^{-p}$ is stored in the temporary register, as at 37. The amounts X and Y by which the operations at 32 and 35 increment the tracking reference or the current sample, as the case may be, can be the same or different; that is, the thresholds chosen to discriminate between large changes, indicating vehicle movement, and small changes can be the same or different for the two directions of change.

Once a quantity, either $+2^{-n}$ or $-2^{-p}$, has been stored in the temporary register, the routine enters a loop 38 in which the loop sub-routine is repeated a number of times determined by the time that has elapsed since the last occasion that the system routine entered this part of the program. In the loop 38 the time count is read, at 39, and the result is tested, at 40, to see if the count is zero—if the answer is 'No' the time count is decremented, at 41, and the fractional quantity in the temporary register, $+2^{-n}$ or $-2^{-p}$ as the case may be, is added to both the tracking reference and the detect reference, at 42. The time count is then re-read and the loop sub-routine is repeated until the test of the time count, at 40, shows that the count has been decremented to zero. The sub-routine then branches out, clears the time count at 30 and returns to the main detection routine 11. By choosing n and p, in the tracking rates of $+2^{-n}$ and $-2^{-p}$, to be the same or different, it is possible to provide for the same or different rates of tracking for the two directions of change.

If either the test at 33 or the test at 36 gives the result negative, it is concluded that there has been a large change since the tracking reference was last stored, indicating the arrival or departure of a vehicle, and the tracking reference is immediately made equal, at 43, to the value of the current sample $+\frac{1}{2}$, after which the time count is cleared at 30 and the process returns to the main detection routine 11. The reason for the added $\frac{1}{2}$ is to put the updated value of the tracking reference at the middle of an integer change so as to give equal chances for environmental change to increase or decrease the reference level. In the same operation at 43 the detect reference fractional byte is set to $\frac{1}{2}$, thus keeping it in step with the tracking reference.

Turning now to FIGS. 2*a* and 2*b*, in which equivalent operations are given the same reference numerals as in FIGS. 1*a* and 1*b*, this is a flow chart illustrating environmental updating based on 'permanent presence' detection. It will be seen that the right hand side of the chart, for updating the tracking reference, is exactly the same as in FIGS. 1*a* and 1*b*. However, the left hand side, for updating the detect reference, is not the same as in FIGS. 1*a* and 1*b* but is now substantially symmetrical with the right hand side.

Thus, after the current sample has been subtracted from the detect reference at 13, if a test at 44 shows the result is not negative, a further test is performed at 45 to see if the result is zero; if it is, the routine branches out, clears the time count at 18 and returns to the main detection routine 11. If the result of the subtraction at 13 is negative, a second subtraction with the detect reference incremented by a threshold amount T and a second negative result test are performed at 46 and 47. If the result of the subtraction at 13 as tested at 44 and 45 is neither negative nor zero, the detect reference is subtracted from the sample incremented by a threshold amount R at 48 and the result tested at 49 to see if it is negative. By this means a decision is made whether to put $+2^{-k}$ or $-2^{-m}$ into a temporary register at 50 or 51. The routine then enters a loop 52, in which the elapsed time count is read at 53, a zero test made at 54, the count decremented at 55, and the contents of the temporary register added to the detect reference at 56, the loop sub-routine repeating until the time count has been decremented to zero.

As on the right hand side of the chart, selection of the thresholds T and R to be the same or different provides for symmetrical or asymmetrical discrimination between large and small changes in the two directions of change; and selection of k and m in the tracking rates $+2^{-k}$ and $-2^{-m}$ to be the same or different provides for symmetrical or asymmetrical tracking in the two directions of change. However, it will be observed that no facility for immediately making the detect reference equal to the current sample is provided. That is to say, if the result of the test at 47 or at 49 is negative, the routine immediately branches out to clear the time count and return to the main detection routine 11. This is because in the 'permanent presence' mode, the necessary environmental updating changes will individually be small and no provision has to be made for sudden large adjustments due to a 'forgotten' long-standing stationary vehicle leaving. The system 'remembers' a vehicle static in the vicinity of the loop and goes on detecting its presence for as long as it remains; i.e. if it stands there for a month it is detected as a vehicle presence for a month, instead of the system regarding it, after a predetermined time, as part of the environment as in 'finite presence' detection.

This ability of the system to 'remember' vehicles indefinitely is rarely required, but one problem it will deal with is that of trucks with many large steel ply radial tyres. The steel plies in such tyres tend to increase inductance; the opposite effect to that of a normal vehicle presence which reduces inductance. If the inductive loop is large, this effect of the tyres is likely to be more than counterbalanced by the opposite effect on inductance of the vehicle chassis, but if the loop is a small one a situation can arise in which a stationary truck with steel ply radial tyres produces an inductance change opposite to that expected from a vehicle. Then in the 'finite presence' mode, if the truck stands long enough to be 'forgotten' by the system, when it eventually leaves the resulting decrease in inductance will seem to the system like a vehicle arriving and a spurious vehicle detection results. By providing 'permanent presence' detection as in FIG. 2*a* and 2*b*, the difficulty is avoided.

In both the modes of FIGS. 1*a* and 1*b*, and 2*a* and 2*b*, the detect and tracking references are updated fractionally and, while the current sample itself is a two-byte sample and decisions are made on that, the detect and tracking reference are each three-byte because they include a fractional byte. The system expects the arrival of a vehicle to reduce the value of the current sample, and the detect condition decision, at 12, is made on the basis that it is 'No' if the current sample plus a detection threshold is greater than the detect reference.

As will be understood, it is possible to measure rate of change of the tracking reference while the system is in the detect condition. The powers m, k, n and p, are chosen in conjunction with the value of time increments to give environmental tracking rates that are suitable for distinguishing the movements of vehicles over the inductive loops from environmental effects on the loops, in the particular situation of the installation. The ability to provide asymmetrical track in the two directions of change has been found to be advantageous, even to the extent in the finite presence time system of FIGS. 1*a* and 1*b* of not tracking at all in the antidetect direction by making the value of n infinity. This same possibility also exists in the permanent presence system of FIGS. 2*a* and 2*b* but the need for it is not envisaged.

I claim:

1. In a vehicle presence detection system in which an inductive sensor loop is an element of a tuned circuit in a loop oscillator, a method of discriminating against parameter variations due to environmental changes during the presence of a vehicle, comprising the steps of repeatedly comparing a variable sample number that is a function of the oscillator inductance with a reference number for providing an indication of the arrival or departure of a vehicle, and repeatedly updating the reference number in accordance with detected environmental changes at predetermined rail time intervals dependent of an operational frequency of the system.

2. A method according to claim 1, wherein at each updating of the reference number in accordance with detected environmental changes a cyclically repeating updating operation is performed in which the reference number is incremented or decremented repeatedly by a predetermined amount for a number of times determined by the real time that has elapsed since a previous occasion that the reference number was compared with the sample number and as a consequence updated or found not to require updating.

3. A method according to claim 2, wherein the reference number is only subjected to said cyclical updating operation for changes in the value of the reference number in one direction.

4. A method according to claim 2, wherein the predetermined amount by which the reference number is incremented or decremented at each cycle of the cyclically repeating updating operation is different according to whether the reference number is being incremented or decremented.

5. A method according to claim 3, wherein the cyclically repeating updating operation is performed on the reference number only if the difference between the reference number and the sample number does not exceed a predetermined threshold value.

6. A method according to claim 5, wherein said predetermined threshold value has a first value when the sample is larger than the reference number and a second and different value when the sample number is smaller than the reference number.

7. A method according to claim 5, wherein before comparison of the sample and reference numbers a decision is made as to whether the system is or is not indicating the presence of a vehicle, and if no vehicle is being indicated a detect reference number is compared with the sample and updated if the comparison so indicates, whereas if a vehicle is being indicated a tracking reference number is compared with the sample number and both the detect reference number and tracking reference number are updated if the comparison so indicates.

8. A method according to claim 7, wherein when the detect reference number is compared with the sample number and found to be different, the cyclical updating operation is performed on the reference number for changes in value in one direction while for changes in the opposite direction the detect reference number is made equal to the sample number in one step.

9. A method according to claim 8, wherein the detect reference number is made equal to the sample number in one step only after two successive comparisons have indicated a requirement for a change of the detect reference number in said opposite direction.

10. A method according to claim 7, wherein if a comparison of the sample number and the tracking reference number shows the difference to be in excess of the threshold value, the tracking reference number is made substantially equal in one step to the sample number.

11. A method according to claim 10, wherein the tracking reference number and the detect reference number both include fractional bytes, and when a difference between the sample number and the tracking reference number exceeds the threshold value, the tracking reference number is made equal to the sample value plus ½ and the fractional byte of the detect reference is set to ½.

* * * * *

UNITED STATES PATENT AND TRADEMARK OFFICE

CERTIFICATE OF CORRECTION

PATENT NO. : 4,862,162

DATED : August 29, 1989

INVENTOR(S) : Richard K. Duley

It is certified that error appears in the above-identified patent and that said Letters Patent is hereby corrected as shown below:

Column 6, line 4, delete "rail" and insert --real--;

Column 6, line 5, delete "dependent" and insert --independent--

Signed and Sealed this

Fifteenth Day of January, 1991

*Attest:*

HARRY F. MANBECK, JR.

*Attesting Officer*

*Commissioner of Patents and Trademarks*